US005190477A

United States Patent [19]

Akeda

[11] Patent Number: 5,190,477

[45] Date of Patent: Mar. 2, 1993

[54] WIRE HARNESS CONNECTION STRUCTURE

[75] Inventor: Nobuyuki Akeda, Shizuoka, Japan

[73] Assignee: Yazaki Corporation, Japan

[21] Appl. No.: 765,089

[22] Filed: Sep. 25, 1991

[30] Foreign Application Priority Data

Sep. 26, 1990 [JP] Japan ..... 2-99725[U]

[51] Int. Cl.[5] ..... H01R 13/40

[52] U.S. Cl. ..... 439/595; 439/872

[58] Field of Search ..... 439/357, 595, 603, 871, 439/872

[56] References Cited

U.S. PATENT DOCUMENTS 4,448,477 5/1984 Gladd et al. ..... 439/872
4,944,696 7/1990 Sueyoshi et al. ..... 439/595
4,969,841 11/1990 Sueyoshi et al. ..... 439/595
4,975,082 12/1990 Nagasaka et al. ..... 439/595
5,066,252 11/1991 Kato et al. ..... 439/595

*Primary Examiner*—Paula A. Bradley
*Attorney, Agent, or Firm*—Venable, Baetjer, Howard & Civiletti

[57] ABSTRACT

A wire harness connection structure includes a connector housing having a plurality of terminal cavities, each of which is equipped with a groove 4 for guiding a reverse inversion preventing projection 6 provided on the terminal when the terminal is inserted in the normal fashion and a tapered guide surface 5 for guiding the projection 6 when the terminal is reversely inserted. When the terminal is reversely inserted, the projection 6 is prevented from moving forwards, thus making the insertion of the terminal impossible.

8 Claims, 3 Drawing Sheets

WIRE HARNESS CONNECTION STRUCTURE

BACKGROUND OF THE INVENTION

1. Field of the Invention

This invention primarily relates to a connector used to connect a wire harness for automobiles and, in particular, to an improvement in a structure for preventing reverse insertion of metallic terminal members.

2. Description of the Related Art

Each terminal cavity of a connector housing is provided with a flexible engagement member formed integrally therewith, which locks a metallic terminal member when it is inserted in the normal manner. The metallic terminal member is equipped with a stabilizer for stabilizing the inserting posture, which stabilizer is adapted to be fitted into a groove and, at the same time, abut against the base section of the flexible engagement member.

If the metallic terminal member is reversely inserted into the terminal cavity, the stabilizer engages with an engagement section formed on the wall surface opposed to the groove, thereby preventing further insertion. However, if its wall thickness is small, the engagement section will be scraped off, leaving the connector open to such reverse insertion. Further, due to limitations in design, it is impossible in some cases for the connector housing to be provided with an engagement section whose wall thickness is large enough to protect it against the reverse insertion preventing projection, such as a stabilizer.

SUMMARY OF THE INVENTION

This invention has been made in view of the above problem. It is accordingly an object of this invention to provide a connection structure in which a reverse insertion preventing projection is provided on the metallic terminal member, and, when the metallic terminal member is reversely inserted into the connector housing, this reverse insertion preventing projection is guided by and engaged with an engagement section of a sufficient level of strength that is provided in the connector housing, thus making it unnecessary to provide the connector housing with an engagement section specially designed for preventing reverse insertion.

In an aspect of this invention, there is provided a wire harness connection structure comprising: a connector housing; a plurality of terminal cavities which are formed in the connector housing and each of which includes a space defined by side walls; a metallic wire terminal which is to be inserted into one of the terminal cavities and which is equipped with a stopper for preventing the terminal from moving forward when it is reversely inserted into one of the terminal cavities; a locking means which is provided in each of the terminal cavities and which is adapted to engage with the terminal when it is inserted into the terminal cavity; a normal insertion guide means which is adapted to guide the stopper when the terminal is inserted in the normal fashion; an engagement section which lodges the stopper when it has been inserted deep into the terminal cavity; a reverse insertion guide means which is provided in each of the terminal cavities and which is adapted to guide the stopper in a direction perpendicular to the longitudinal axis of the terminal cavity when it is reversely inserted; and a stop section which abuts against the stopper thus guided so as to make the insertion of the terminal impossible.

Preferably, the locking means consists of a flexible member which extends from one of the side walls defining the above-mentioned space of the terminal cavity and which is opposed to the inserted terminal.

In an embodiment of this invention, the stopper consists of a tab radially protruding from the terminal member. Preferably, the normal insertion guide means is formed on the side wall opposed to the locking means. It is desirable that the normal insertion guide means consist of a groove formed in the side wall opposed to the locking means and extending in the direction of the longitudinal axis of the terminal cavity.

Further, the reverse insertion guide means is preferably formed between the flexible member and the side wall, constituting a tapered surface raised from the bottom section of the connector housing.

BRIEF DESCRIPTION OF THE DRAWINGS

The construction, features, effects, and advantages of this invention will become more apparent from the following description of an embodiment with reference to the accompanying drawings, in which.

DESCRIPTION OF THE PREFERRED EMBODIMENT

Figure 1:
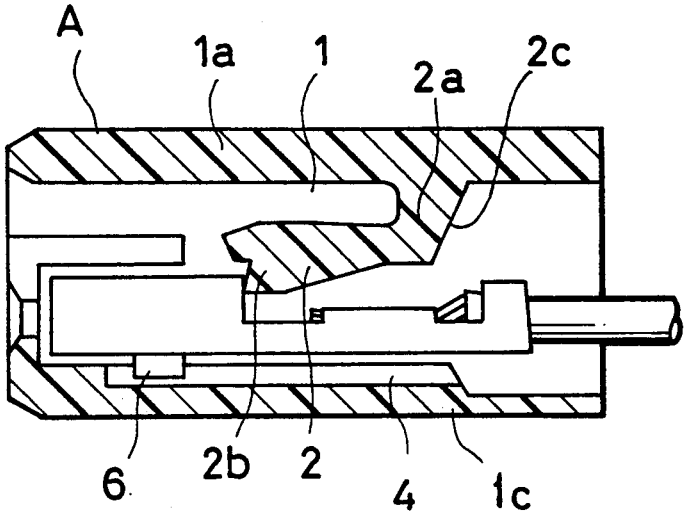
FIG. 1 is a longitudinal sectional view of a connector housing in accordance with an embodiment of this invention.
Figure 2:
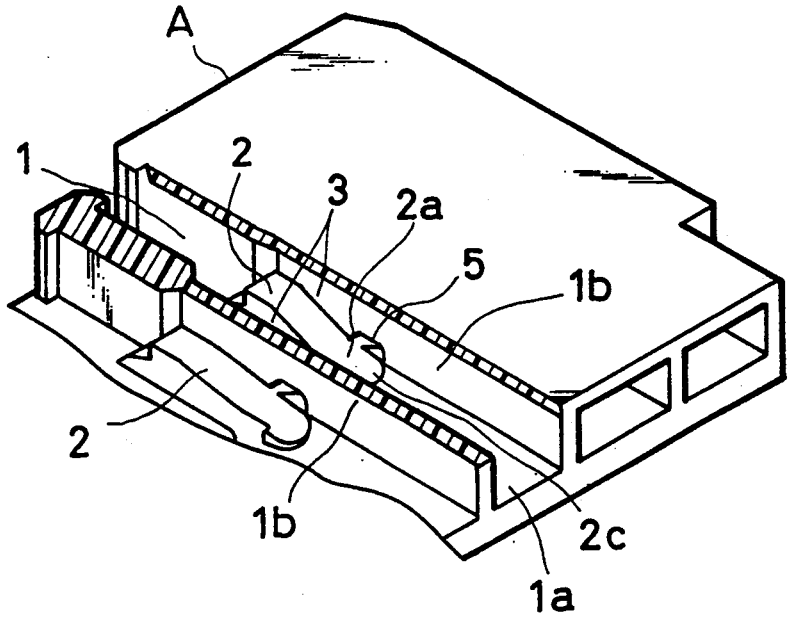
FIG. 2 is a partially cutaway perspective view of the same.
Figure 3:
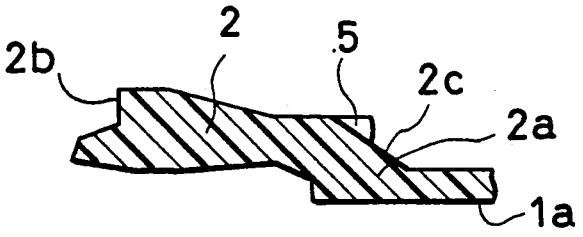
FIG. 3 is a sectional view showing the essential part of the same.
Figure 4:
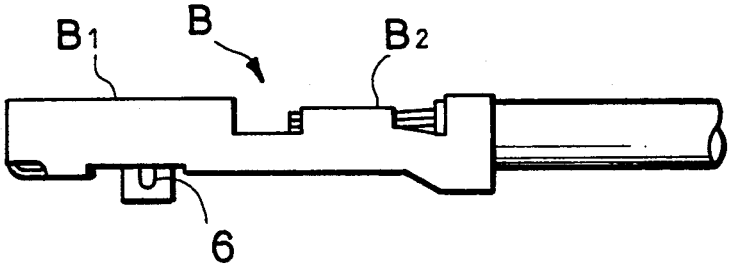
FIG. 4 is a side view of a metallic terminal member.

Referring to FIGS. 1 and 2, provided in a terminal cavity 1 of a connector housing A is a flexible engagement member 2, which protrudes forwardly from the upper wall 1*a* of the terminal cavity 1 through the intermediation of a base portion 2*a*. As is well known in the art, the flexible engagement member 2 is formed such that it defines gaps 3 between it and side walls 1*b* extending in the direction of its extension, and has a locking section 2*b* at its free end. A groove 4 is formed in the bottom wall 1*c* of the connector housing A.

Formed on the above mentioned base portion 2*a* of the flexible engagement member 2 is a tapered raised surface 2*c*, and, formed on one side wall 1*b* is a tapered guide surface 5, which protrudes from that side wall in such a manner as to block one of the above-mentioned gaps 3.

A metallic terminal member B consists of a female electrical contact section $B_1$ and a wire contact section $B_2$. Provided on the bottom side of the electrical contact section $B_1$ is a reverse insertion preventing projection 6, which protrudes downwards.

When, in the construction described above, the metallic terminal member B is inserted into the terminal cavity 1 in the normal fashion, the reverse insertion preventing projection 6 gets into the groove 4, and the locking section 2*b* of the flexible engagement member 2 engages with the rear end of the electrical contact section $B_1$ (FIG. 1).

Figure 5:
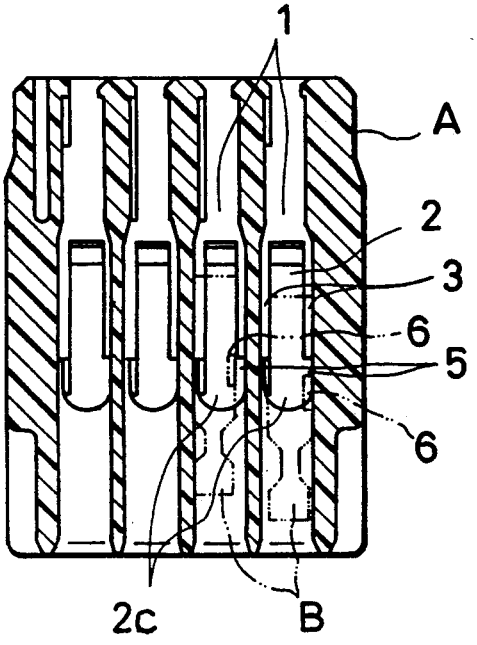
FIG. 5 is a cross-sectional view of the connector housing, illustrating the metallic terminal member inserting process.
Figure 6A:
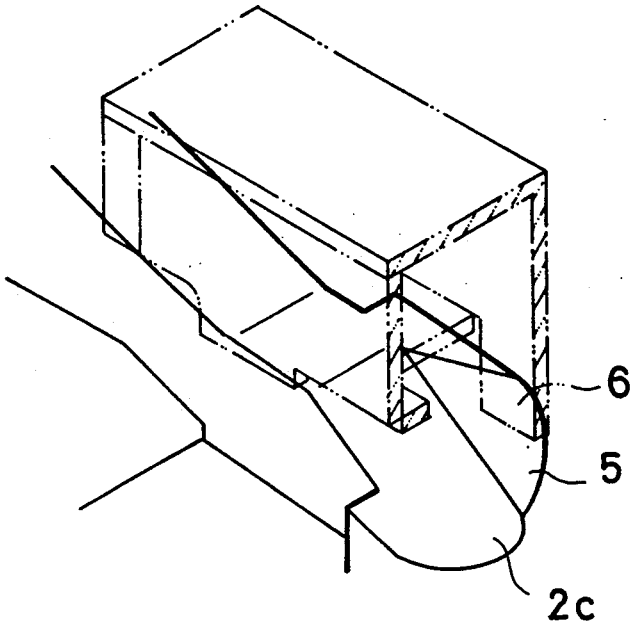
FIGS. 6(*a*) and 6(*b*) are perspective views of the essential part of the same, illustrating the metallic terminal member inserting process.
Figure 6B:
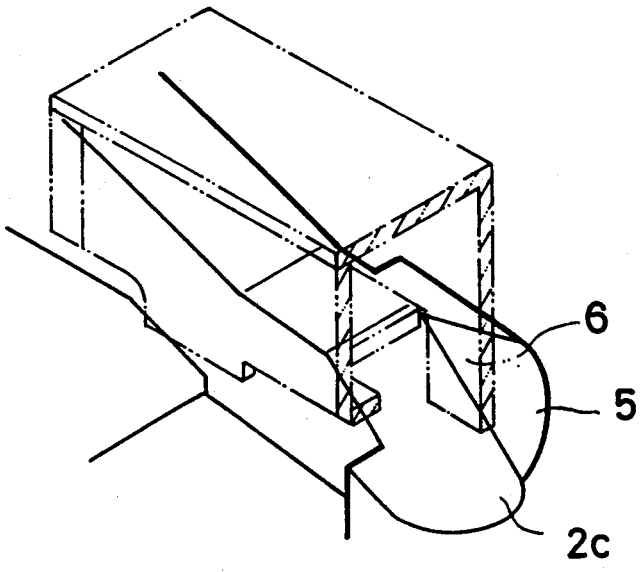

If the metallic terminal member B is inserted reversely into the terminal cavity 1, the reverse insertion preventing protrusion 6 abuts against the tapered guide surface 5, as shown in FIGS. 5, 6(*a*) and 6(*b*). The metallic terminal member B is displaced in the direction intersecting the direction of insertion, and the reverse insertion preventing projection 6 engages with the strongly built base portion 2*a*, thus preventing the metallic terminal member B from being reversely inserted.

Thus, in accordance with this invention, reverse insertion of the metallic terminal member can be reliably prevented without providing the connector housing with a locking section specially designed for preventing reverse insertion.

While the present invention has been described with reference to a preferred embodiment thereof, it is to be distinctly understood that it is not limited to what is present in the above description and drawings and that various changes and modifications can be made easily by those skilled in the art. That is, this invention is intended to cover all the technical matter derived from the basic principle as shown in the appended claims.

What is claimed is:

1. A wire harness connection structure comprising:

a connector housing having a plurality of terminal cavities, each of which provides a space defined by side walls;

a metallic wire terminal which is to be inserted into one of said terminal cavities and which is equipped with a stopper for preventing said terminal from moving if said terminal is reversely inserted into one of said terminal cavities;

locking means provided in each of said terminal cavities and which is adapted to engage and support said terminal when said terminal is inserted into one of said terminal cavities;

normal insertion guide means provided in each of said terminal cavities and which is adapted to guide said stopper when said terminal is inserted into one of said terminal cavities in a normal fashion; and reverse insertion guide means provided in each of said terminal cavities and which is adapted to guide said stopper in a direction perpendicular to the longitudinal axis of said terminal cavities if said terminal is reversely inserted into one of said terminal cavities;

wherein said locking means is provided with an engagement section, which lodges said stopper when said terminal is inserted deep into one of said terminal cavities, and a stop section which, if said terminal is reversely inserted into one of said terminal cavities, abuts against said stopper guided by said reverse insertion guide means.

2. A connection structure as claimed in claim 1, wherein said stopper comprises a tab radially protruding from said terminal.

3. A connection structure as claimed in claim 1, wherein said reverse insertion guide means comprises a tapered surface raised from a wall of said connector housing.

4. A connection structure as claimed in claim 1, wherein said normal insertion guide means is formed on the side wall opposed to said locking means.

5. A connection structure as claimed in claim 4, wherein said normal insertion guide means extends in the direction of a longitudinal axis of said locking means.

6. A connection structure as claimed in claim 1, wherein said locking means consists of a flexible member which protrudes from one of said side walls defining said

7. A connection structure as claimed in claim 6, wherein said reverse insertion guide means is formed between said flexible member and said side wall.

8. A connection structure as claimed in claim 6, wherein said stopper comprises a tab radially protruding from said terminal.

* * * * *